US006727783B2

(12) United States Patent
Kanba et al.

(10) Patent No.: US 6,727,783 B2
(45) Date of Patent: Apr. 27, 2004

(54) METHOD OF PRODUCING BAND-PASS FILTER AND BAND-PASS FILTER

(75) Inventors: Seiji Kanba, Kusatsu (JP); Naoki Mizoguchi, Shiga-ken (JP); Hisatake Okamura, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/170,681

(22) Filed: Jun. 14, 2002

(65) Prior Publication Data

US 2002/0149447 A1 Oct. 17, 2002

Related U.S. Application Data

(62) Division of application No. 09/782,981, filed on Feb. 14, 2001.

(30) Foreign Application Priority Data

Feb. 24, 2001 (JP) ..... 2000-047918

(51) Int. Cl.[7] ..... H01P 1/203

(52) U.S. Cl. ..... 333/204; 333/219

(58) Field of Search ..... 333/99 S, 204, 333/219, 205

(56) References Cited

U.S. PATENT DOCUMENTS

| | | | | |
|---|---|---|---|---|
| 3,639,857 A | * | 2/1972 | Okoshi et al. | 331/107 R |
| 5,136,268 A | * | 8/1992 | Fiedziuszko et al. | 333/204 |
| 5,172,084 A | * | 12/1992 | Fiedziuszko et al. | 333/204 |
| 5,914,296 A | * | 6/1999 | Shen | 505/210 |
| 6,239,674 B1 | * | 5/2001 | Enokihara et al. | 333/204 |
| 6,252,475 B1 | * | 6/2001 | Enokihara et al. | 333/204 |

* cited by examiner

*Primary Examiner*—Robert Pascal
*Assistant Examiner*—Dean Takaoka
(74) *Attorney, Agent, or Firm*—Keating & Bennett, LLP

(57) ABSTRACT

A method of producing a band-pass filter includes selecting the shape of a metallic film and the connection points of input-output coupling circuits such that first and second resonance modes are generated in a metallic film provided on a dielectric substrate. At least a portion of the resonance current or the resonance electric field in at least one of the resonance modes is made discontinuous such that the first and second resonance modes are coupled.

10 Claims, 23 Drawing Sheets

METHOD OF PRODUCING BAND-PASS FILTER AND BAND-PASS FILTER

This is a divisional of application Ser. No. 09/782,981 filed on Feb. 14, 2001, currently pending.

BACKGROUND OF THE INVENTION

1. Field of the Invention

The present invention relates to a band-pass filter and, more particularly, to a method of producing a band-pass filter, for example, for use in a communication device operated in a micro-wave band to a millimeter-wave band and a band-pass filter.

2. Description of the Related Art

Conventionally, LC filters have been used as band-pass filters. FIG. 26 shows an equivalent circuit of a conventional LC filter.

The LC filter includes first and second resonators 101 and 102. The resonators 101 and 102 each include a capacitor C and an inductance L connected in parallel to each other. Conventionally, to define the LC filter as a single electronic component, a monolithic capacitor and a monolithic inductor are integrated with each other. In particular, to achieve the circuit configuration shown in FIG. 26, two resonators each including a monolithic capacitor component and a monolithic inductor component are provided as one monolithic electronic component. In the LC filter, two resonators 101 and 102 are coupled to each other via a coupling capacitor C1.

When the LC filter having the circuit configuration shown in FIG. 26 is provided as a single component, it is necessary to provide many conductor patterns and via-hole electrodes for connecting the conductor patterns to each other. Accordingly, to obtain a desired characteristic, the above conductor patterns and via-hole electrodes must be formed with high accuracy.

As described above, to form the LC filter, many electronic elements are required. Accordingly, the LC filter has a complicated configuration, and the size of the LC filter cannot be substantially reduced. In addition, the resonance frequencies of LC filters are generally expressed as $f=1/2\pi(LC)^{1/2}$, in which L represents the inductance of a resonator, and C represents the capacitance thereof. Accordingly, to obtain an LC filter that operates at a high frequency, it is necessary to reduce the product of the capacitor C of the resonator and the inductance L. That is, for production of an LC filter that operates at a high frequency, it is necessary to reduce errors, caused in the production of the inductance L and the capacitance C of the resonator. Accordingly, to develop a resonator that operates at a still higher frequency, the accuracy of the above many conductor patterns and via-hole electrodes as described above must be further enhanced. Thus, development of LC filters for use at a higher frequency has been very difficult.

SUMMARY OF THE INVENTION

To overcome the above-described problems, preferred embodiments of the present invention provide a method of producing a band-pass filter in which the above-described technical difficulties are greatly reduced, and the band-pass filter which operates at a high frequency is easily produced, miniaturization of the band-pass filter is easily performed, and for which control conditions of dimensional accuracy are greatly relaxed, and a band-pass filter.

According to preferred embodiments of the present invention, a method of producing a band-pass filter is provided which includes the steps of selecting the shape of a metallic film and the connection points of input-output coupling circuits with respect to the metallic film such that first and second resonance modes are generated in the metallic film, the metallic film is provided on a surface of a dielectric substrate or inside of the dielectric substrate, and discontinuous providing at least a portion of the resonance current and the resonance electric field in at least one of the resonance modes such that the first and second resonance modes are coupled.

Preferably, in the step in which the first and second resonance modes are coupled, at least a portion of the resonance current in at least one of the resonance modes is discontinuous.

Also preferably, in the step in which the first and second resonance modes are coupled, at least a portion of the resonance current in at least one of the resonance modes is discontinuous.

According to preferred embodiments of the present invention, a band-pass filter is provided which includes a dielectric substrate, one metallic film provided on a surface of the dielectric substrate or inside of the dielectric substrate, input-output coupling circuits connected to first and second portions of the periphery of the metallic film, the shape of the metallic film and the positions of the connection points of the input-output coupling circuits are selected such that the first resonance mode propagated substantially in parallel to the imaginary straight line passing through the connection points of the input-output coupling circuits, and the second resonance mode propagated substantially in the perpendicular direction of the imaginary straight line are generated, and a coupling mechanism for discontinuously providing at least a portion of the resonance current or resonance electric field whereby the first and second resonance modes are coupled to each other.

Preferably, the coupling mechanism is a resonance current control mechanism for discontinuously providing at least a portion of the resonance current in at least one of the resonance modes.

The resonance current control mechanism may be an opening provided in the metallic film.

Preferably, the coupling mechanism is a resonance electric field control mechanism for controlling the resonance electric field in at least one of the resonance modes.

The resonance electric field control mechanism may be a resonance electric field control electrode arranged opposed to the metallic film through at least a portion of the layers of the dielectric substrate.

Other features, characteristics, elements and advantages of the present invention will become apparent from the following description of preferred embodiments thereof with reference to the attached drawings.

DETAILED DESCRIPTION OF PREFERRED EMBODIMENTS

Hereinafter, a method of producing a band-pass filter and a band-pass filter in accordance with preferred embodiments of the present invention will be described with reference to the accompanying drawings.

In the band-pass filter of various preferred embodiments of the present invention, one metallic film is provided on a dielectric substrate or inside of the dielectric substrate. Input-output coupling circuits are connected to first and second portions of the periphery of the metallic film. In a resonator having the above structure, the resonance form is determined by the connection-point positions of the input-output coupling circuits. This will be described in reference to FIGS. 1A to 16.

Figure 1A:
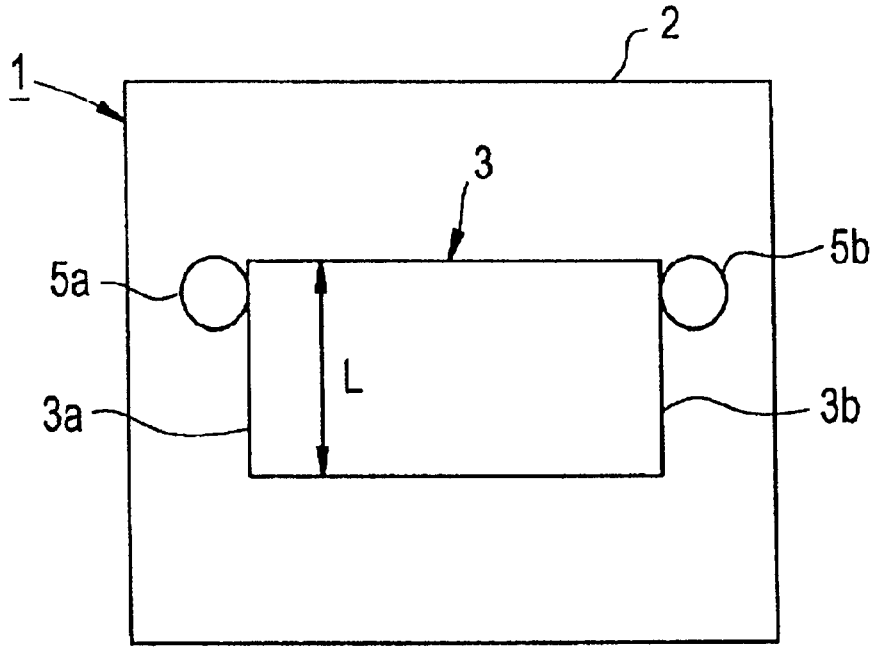
FIG. 1A is a plan view of a preferred embodiment of a microstrip type resonator according to the present invention.
Figure 1B:
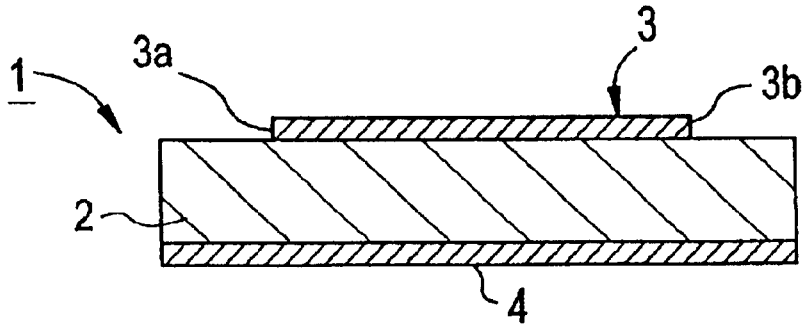
FIG. 1B is a cross sectional view thereof.
Figure 2:
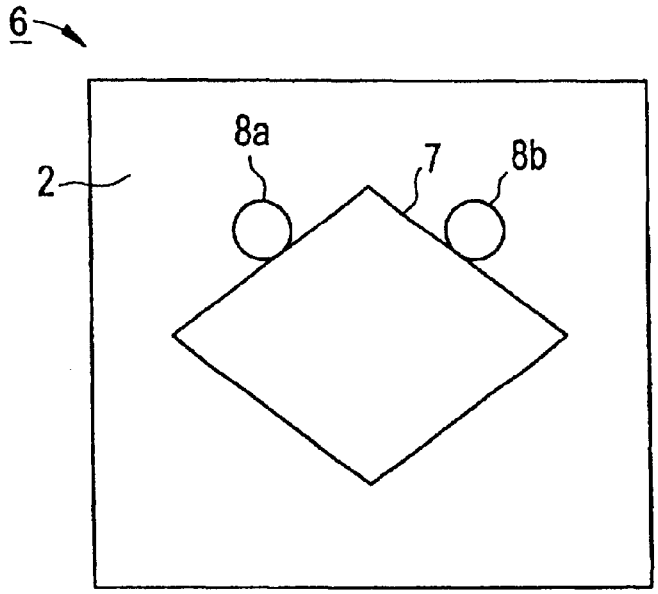
FIG. 2 is a plan view of another preferred embodiment of the microstrip line type resonator according to the present invention.
Figure 3:
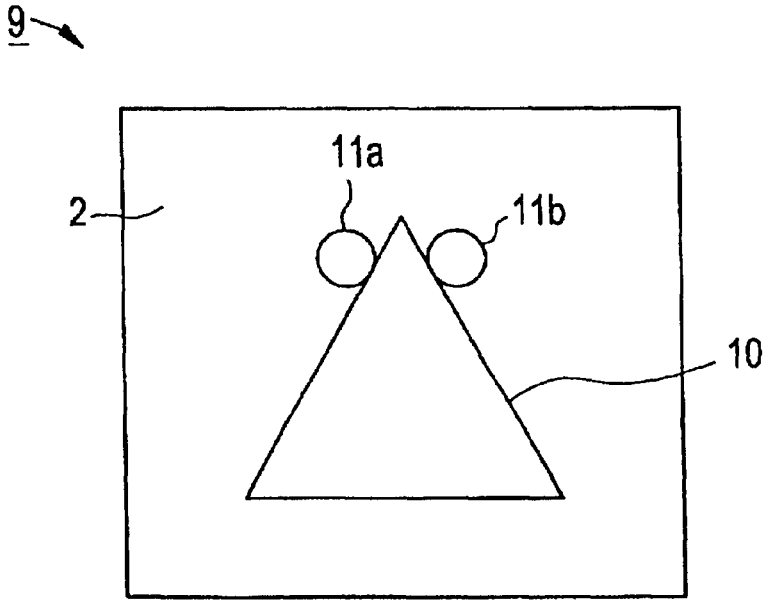
FIG. 3 is a plan view of yet another preferred embodiment of the microstrip line type resonator according to the present invention.

As the resonator having the above structure, the inventors of the present invention prepared the resonators having a microstrip structures shown in FIGS. 1 to 3, and evaluated the resonance forms.

In particular, a resonator 1 shown in FIGS. 1A and 1B, a substantially rectangular metallic film 3 is provided in the approximate center of the upper surface of a dielectric substrate 2. Furthermore, a ground electrode 4 is provided on substantially the entire lower surface of the dielectric substrate 2. Input-output coupling circuits are connected to the ends of the short sides 3*a* and 3*b* opposed to each other on the dielectric substrate 2, respectively. That is, the connection points 5*a* and 5*b* of the input-output coupling circuits are indicated by circular marks in FIG. 1A.

Resonators 6 and 9 shown in FIGS. 2 and 3 were prepared in the same manner as the resonator 1, except the shapes of the metallic films are a rhombus and a triangle. In the resonator 6, the metallic film 7 has a substantially rhomboid shape, and the input-output connection points 8*a* and 8*b* of the input-output coupling circuits are positioned on adjacent sides of the rhomboid shape. Furthermore, in the resonator 9, the metallic film has a substantially triangular shape, and the input-output connection points 11*a* and 11*b* are positioned on two adjacent sides.

Figure 4:
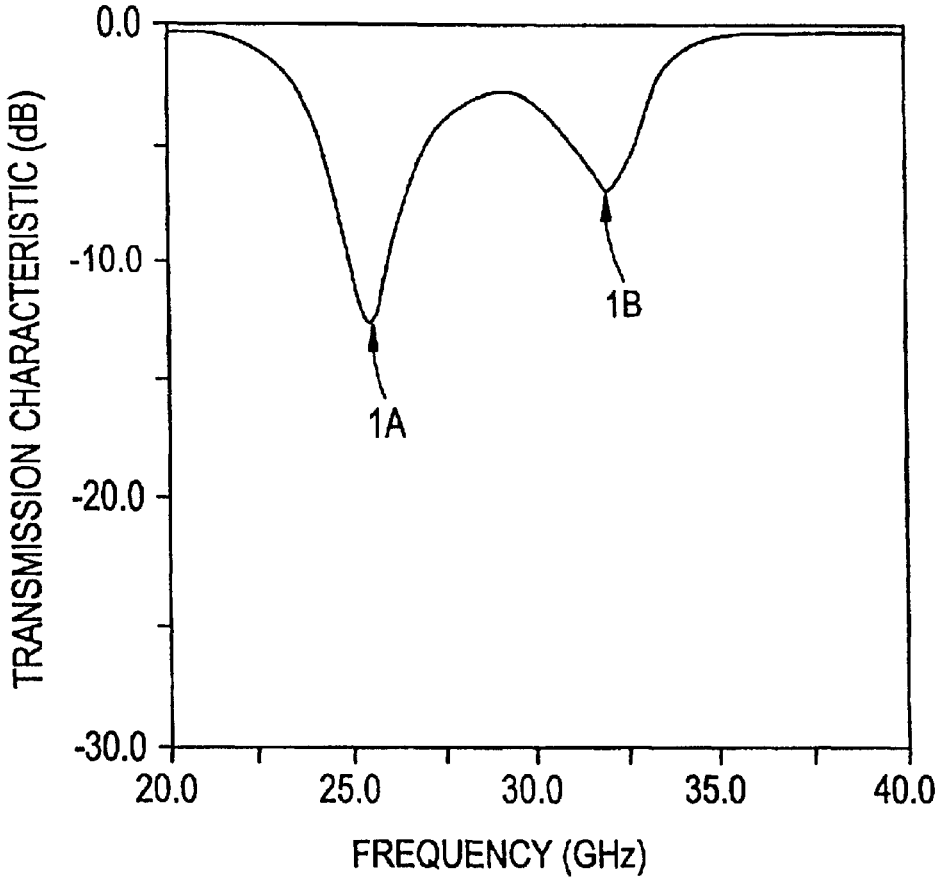
FIG. 4 is a graph of the frequency characteristic of the resonator shown in FIGS. 1A and 1B, in which the resonance at the lowest frequency and that at the next lowest frequency in the resonator are illustrated.
Figure 5:
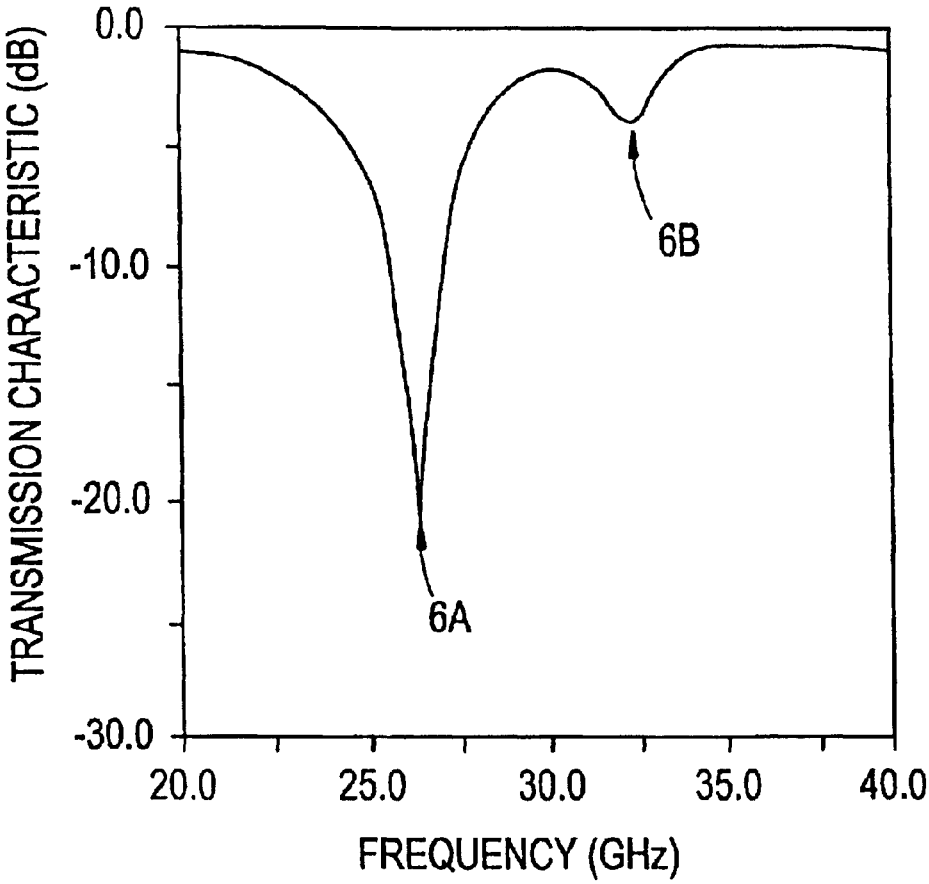
FIG. 5 is a graph of the frequency characteristic of the resonator shown in FIG. 2, in which the resonance at the lowest frequency and that at the next lowest frequency in the resonator are illustrated.
Figure 6:
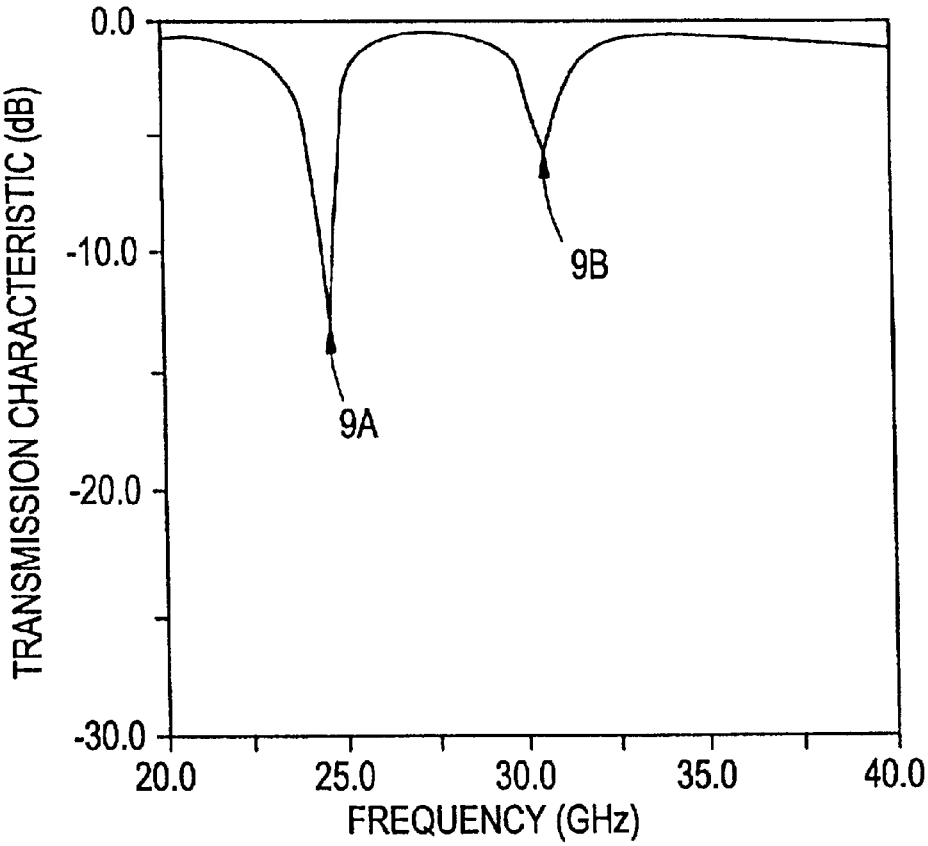
FIG. 6 is a graph of the frequency characteristic of the resonator shown in FIG. 3, in which the resonance at the lowest frequency and that at the next lowest frequency of the resonator are illustrated.

FIGS. 4 to 6 show the frequency characteristics of the above-mentioned resonators 1, 6, and 9.

Resonance points produced in the lowest frequency band and in the next lowest frequency band in each of the resonators 1, 6, and 9 are shown in FIGS. 4 to 6.

For example, arrow 1A in FIG. 4 indicates a resonance point appearing in the lowest frequency band in the resonator 1, while arrow 1B indicates a resonance point in the next lowest frequency band. Similarly, arrows 6A and 6B in FIG. 5 indicate resonance points appearing in the lowest frequency band and the next lowest frequency band in the resonator 6, respectively. A resonance point 9A shown in FIG. 6 appears in the lowest frequency band in the resonator 6, and a resonance point 9B appears in the next lowest frequency range.

Figure 7:
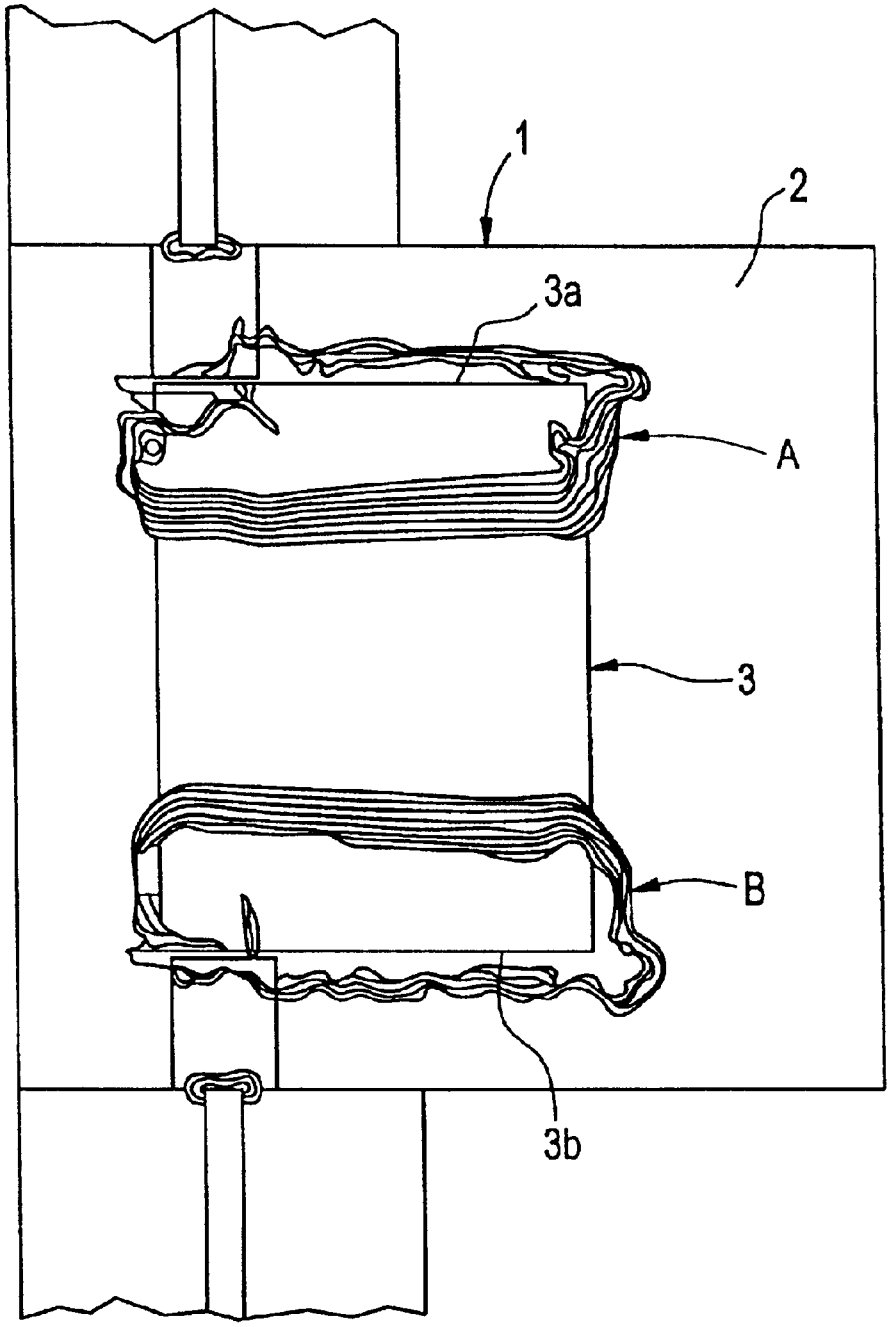
FIG. 7 shows the electric field strength distribution of the resonance 1A at the lowest frequency in the resonator shown in FIGS. 1A and 1B.
Figure 8:
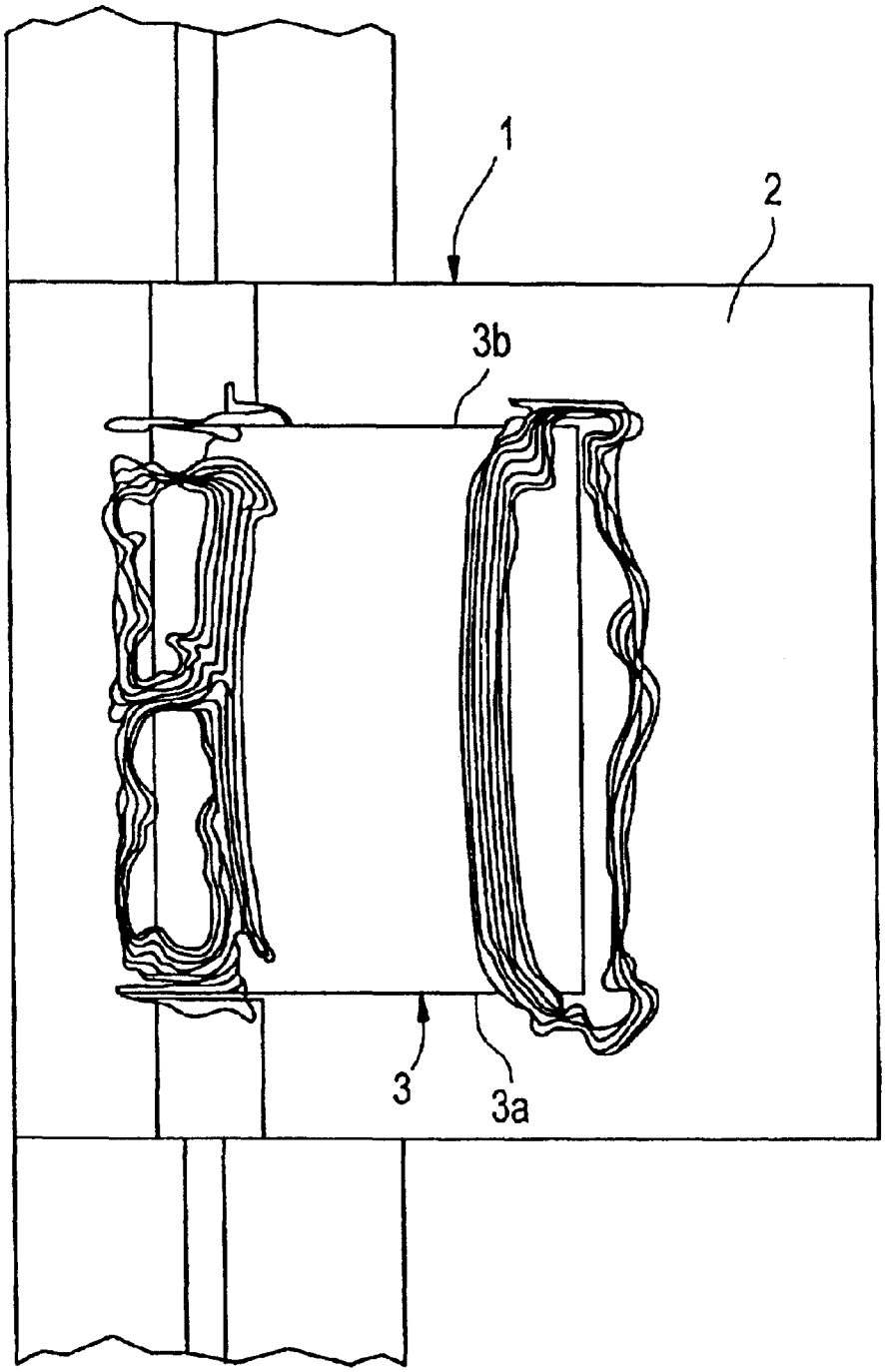
FIG. 8 shows the electric field strength distribution of the resonance 1B at the next lowest frequency in the resonator shown in FIGS. 1A and 1B.

The two resonance modes in each of the above-described resonators were identified by an electromagnetic field simulator (manufactured by Hewlett-Packard Co., stock number: HFSS). FIGS. 7 to 12 show the results. FIGS. 7 and 8 show the resonance states (hereinafter, referred to as resonance modes 1A and 1B in some cases) at the resonance points 1A and 1B in the resonator 1, respectively. FIGS. 7 and 8 each show the areas between the ground electrode 4 and the metallic film 3 in which a high field strength is produced in the respective resonance states. For example, in FIG. 7, the field strengths are improved in the areas indicated by arrows A and B, respectively. That is, in the case of the resonator 1, the field strengths are increased in the vicinity of the both-ends in the longitudinal direction of the substantially rectangular metallic film 3 in the resonance mode 1A that appears in the lowest frequency band.

On the contrary, the field strengths are improved in the vicinity of a pair of the longer sides of the substantially rectangular metallic films 3 in the resonance mode 1B, as shown in FIG. 8.

Figure 9:
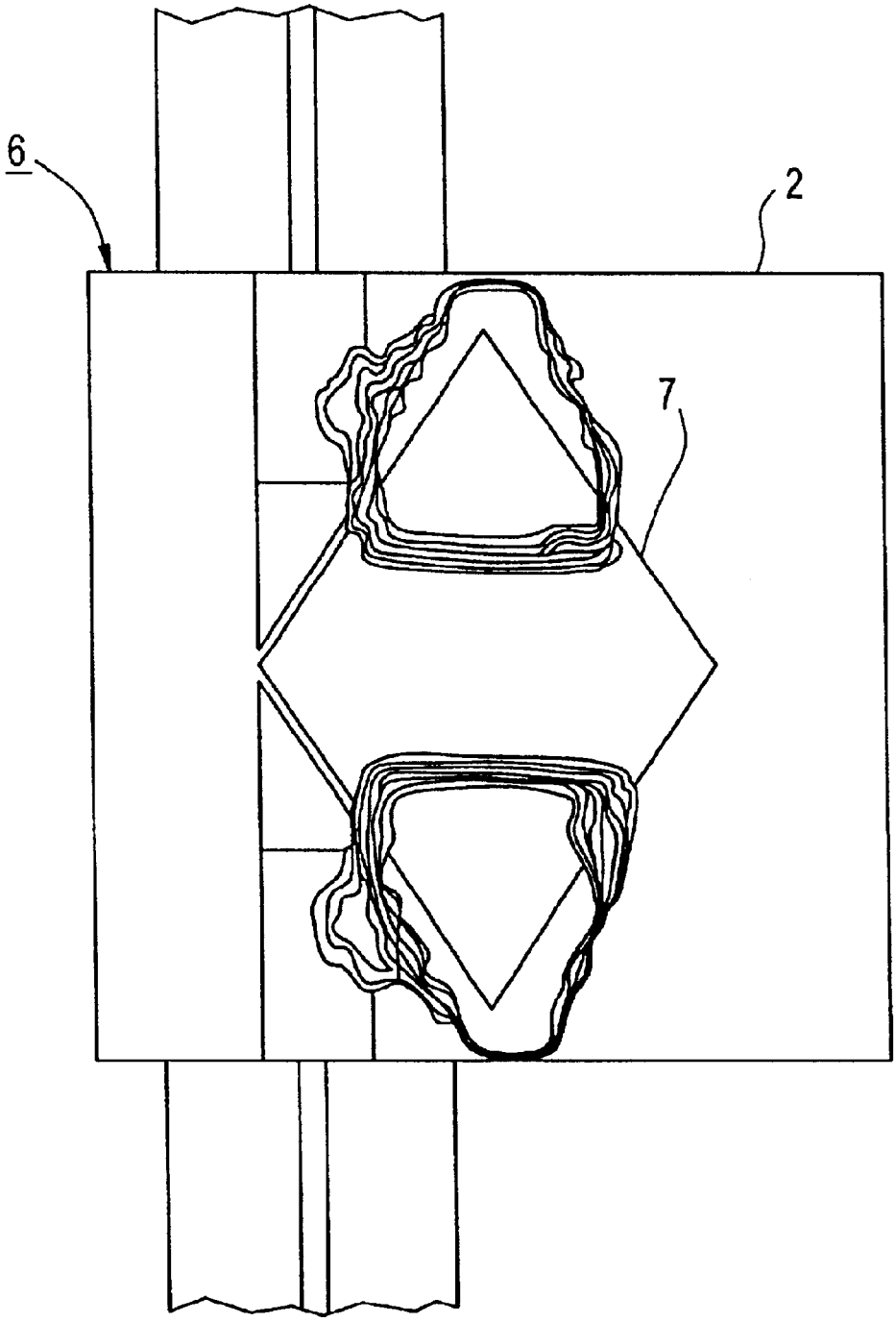
FIG. 9 shows the electric field strength distribution of the resonance 5A at the lowest frequency in the resonator shown in FIG. 2.
Figure 10:
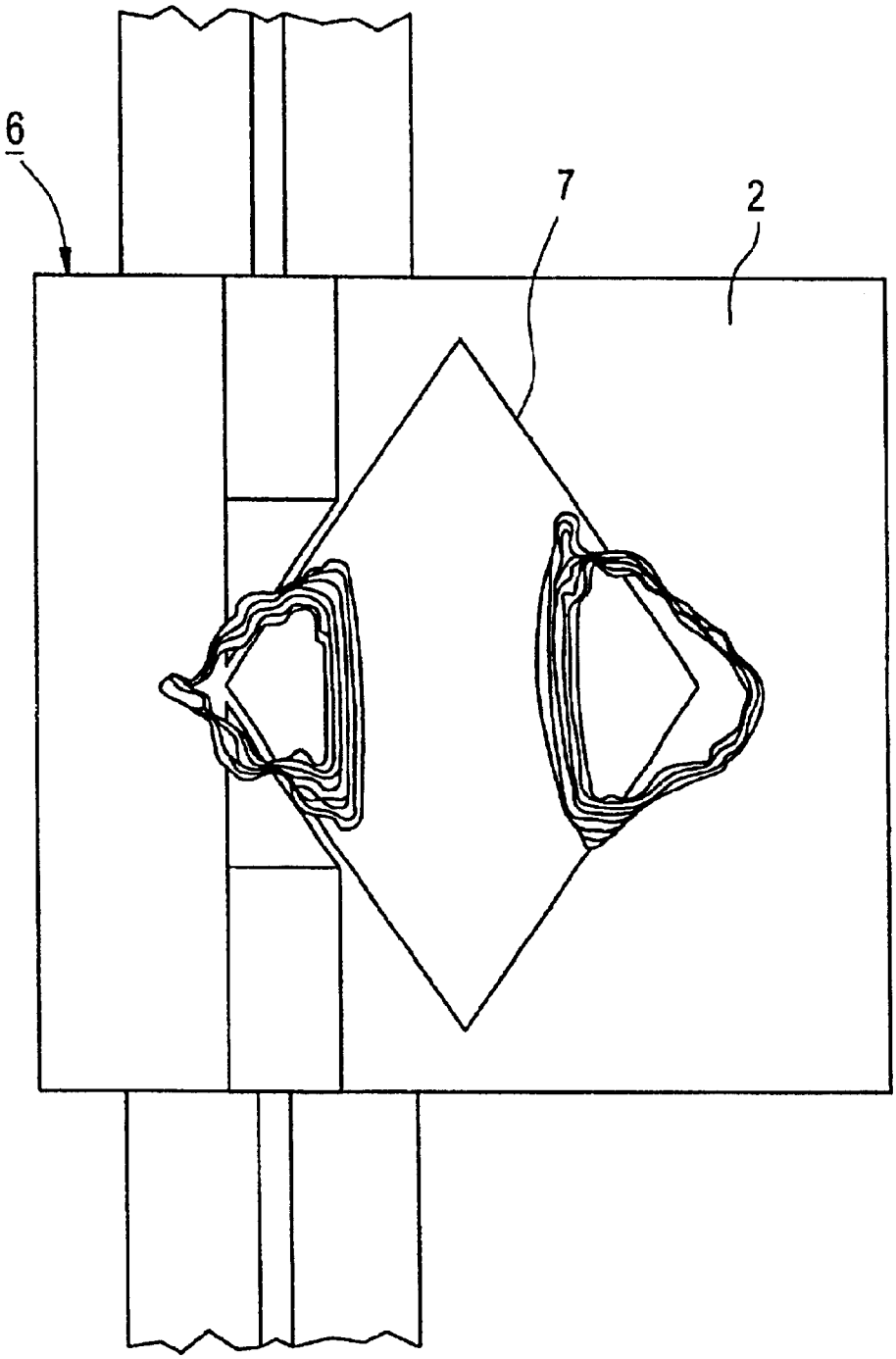
FIG. 10 shows the electric field strength distribution in the resonance 5B at the next lowest frequency of the resonator shown in FIG. 2.

As shown in FIGS. 9 and 10, in the resonance mode 6A of the resonator 6, the field strengths are improved in the vicinity of both ends of the longer diagonal line of the rhomboid metallic film 7. In the resonance mode 6B, the field strengths are improved in the vicinity of the both-ends of the short diagonal line of the metallic film 7.

Figure 11:
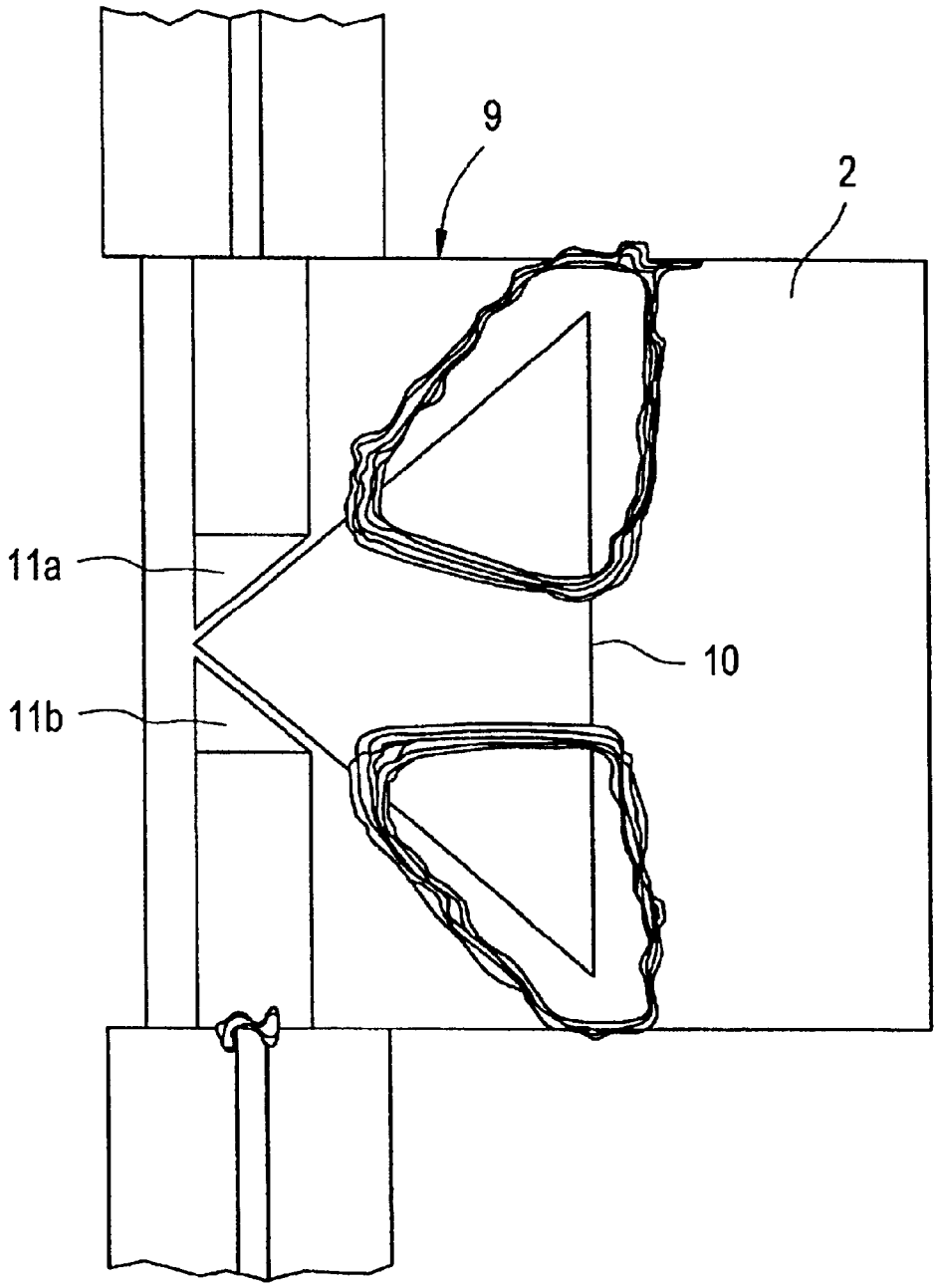
FIG. 11 shows the electric field strength distribution of the resonance 6A at the lowest frequency in the resonator shown in FIG. 3.
Figure 12:
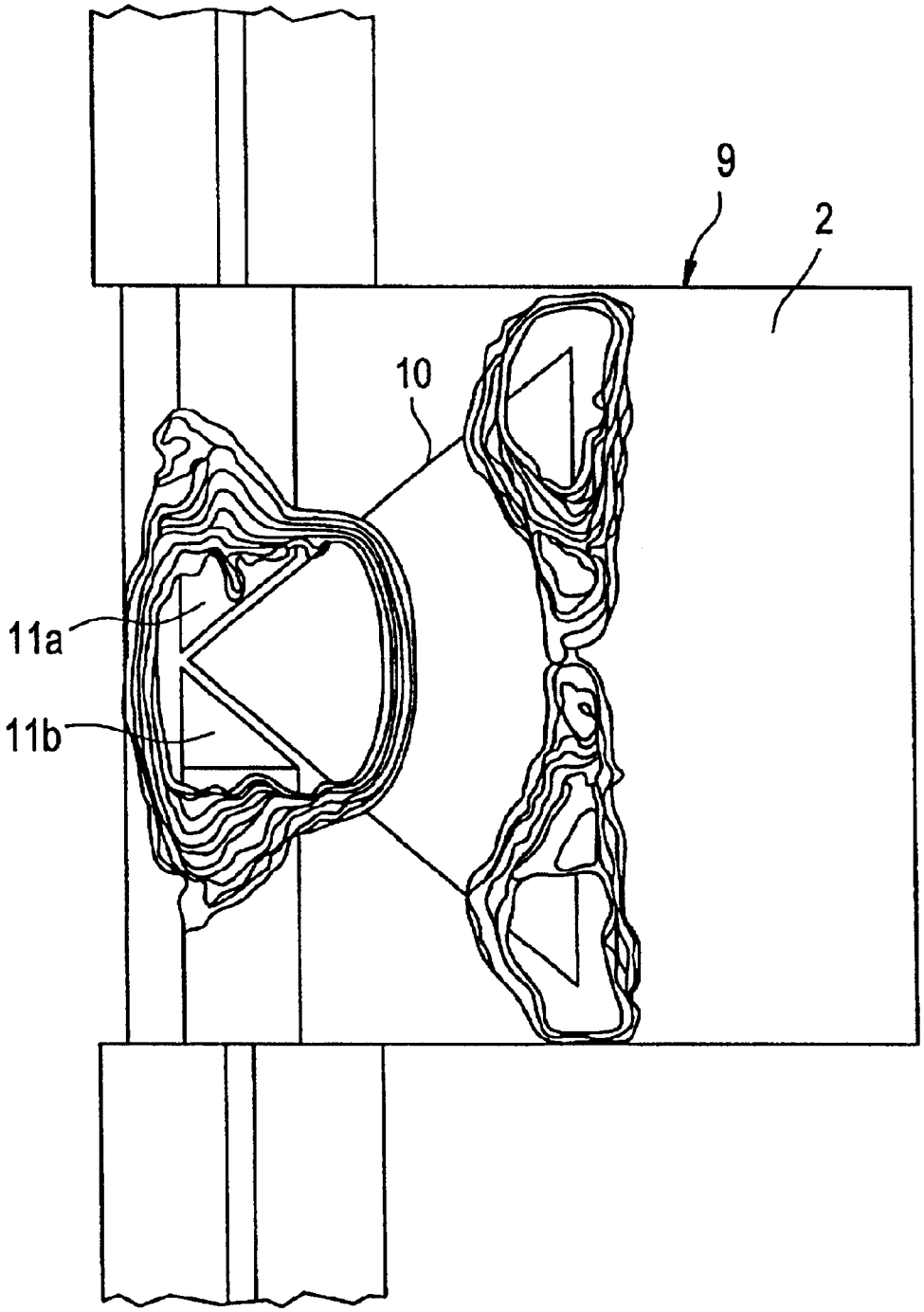
FIG. 12 shows the electric field strength distribution of the resonance 6B at the next lowest frequency in the resonator shown in FIG. 3.

Furthermore, as seen in FIGS. 11 and 12, in the resonance mode 9A of the resonator 9, the field strengths are improved in the vicinity of both ends of the side of the substantially triangular metallic film 10, which is different from the sides in which the input-output connection points 11*a* and 11*b* are arranged. In the resonance mode 9B, the field strengths are improved in the vicinity of the vertex where the input-output connection points are arranged and moreover, in the vicinity of both ends of the side in which the input-output connection points are not arranged.

That is, as seen in FIGS. 7 to 12, the excited resonance forms are different, depending on the shapes of the metallic films 3, 7, and 10, and the positions of the input-output connection points 5*a*, 5*b*, 8*a*, 8*b*, 11*a*, and 11*b*.

The above resonance forms will be described in detail with reference to the resonator 1 of FIG. 1 as an example.

Figure 13:
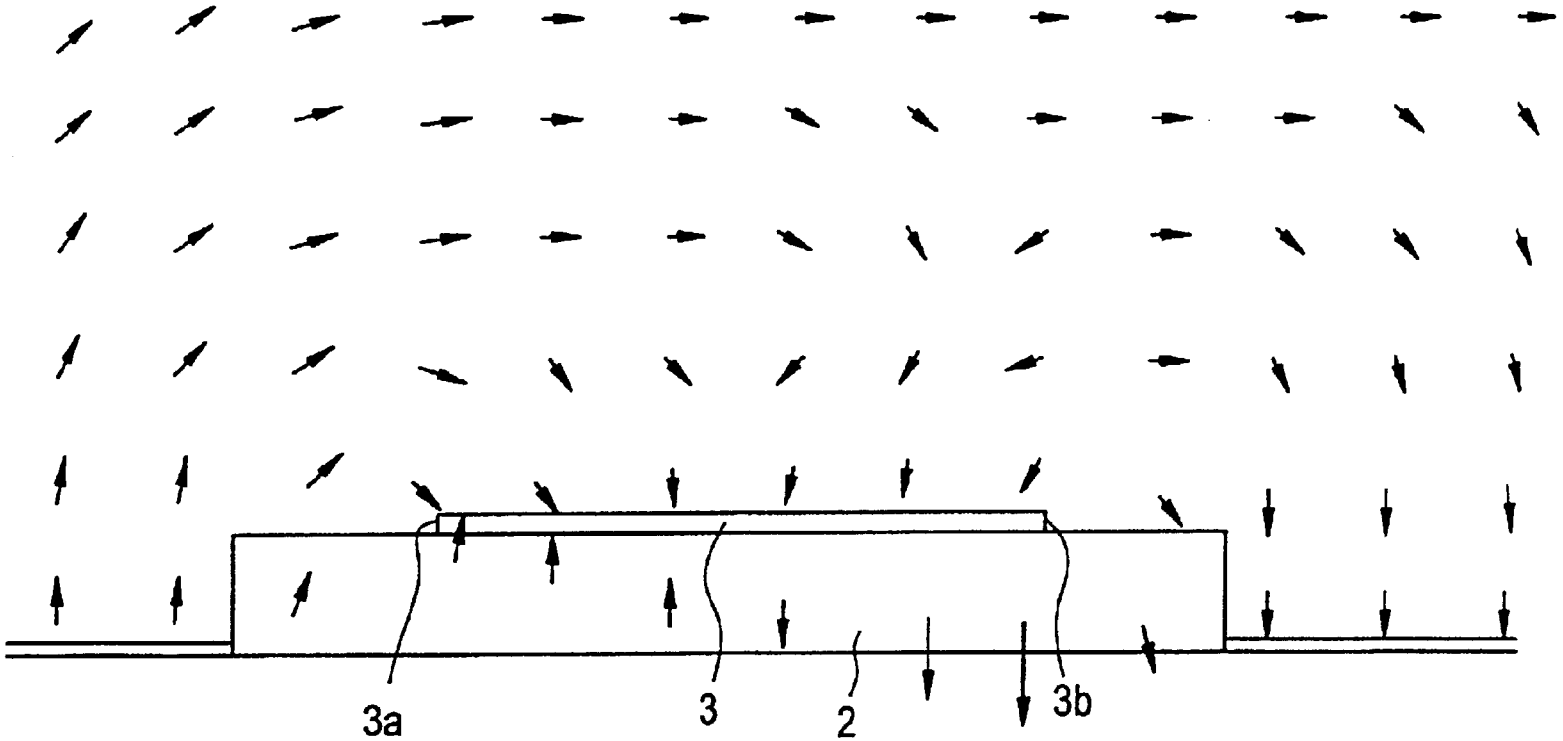
FIG. 13 is a schematic cross sectional view showing the electric field vector distribution of the resonance 1A at the lowest frequency in the resonator shown in FIGS. 1A and 1B.

Referring to the resonance mode 1A of the resonator 1 shown in FIG. 7, the state of the field vector in the thickness direction of the dielectric substrate is shown in FIG. 13. In FIGS. 7 and 13, it is seen that in the resonance mode 1A of the resonator 1, $\lambda/2$ resonance is generated at the resonator length which is the interval between the opposed two sides of the substantially rectangular metallic film 3.

Figure 14:
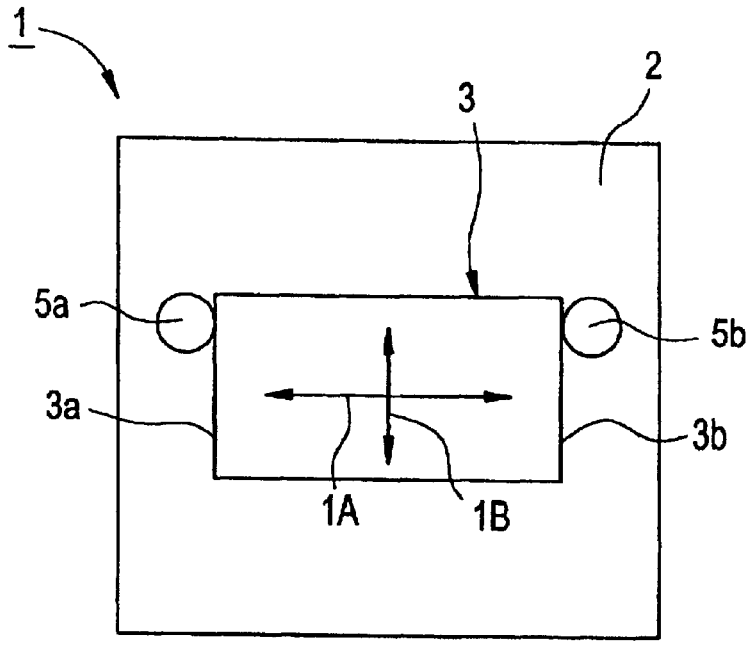
FIG. 14 is a schematic plan view of two resonance modes in the resonator shown in FIGS. 1A and 1B.
Figure 15:
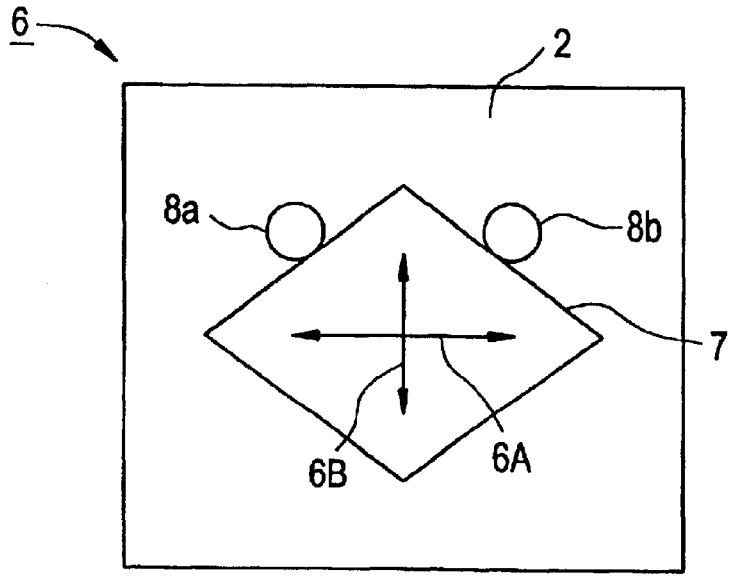
FIG. 15 is a schematic plan view of two resonance modes in the resonator shown in FIG. 2.
Figure 16:
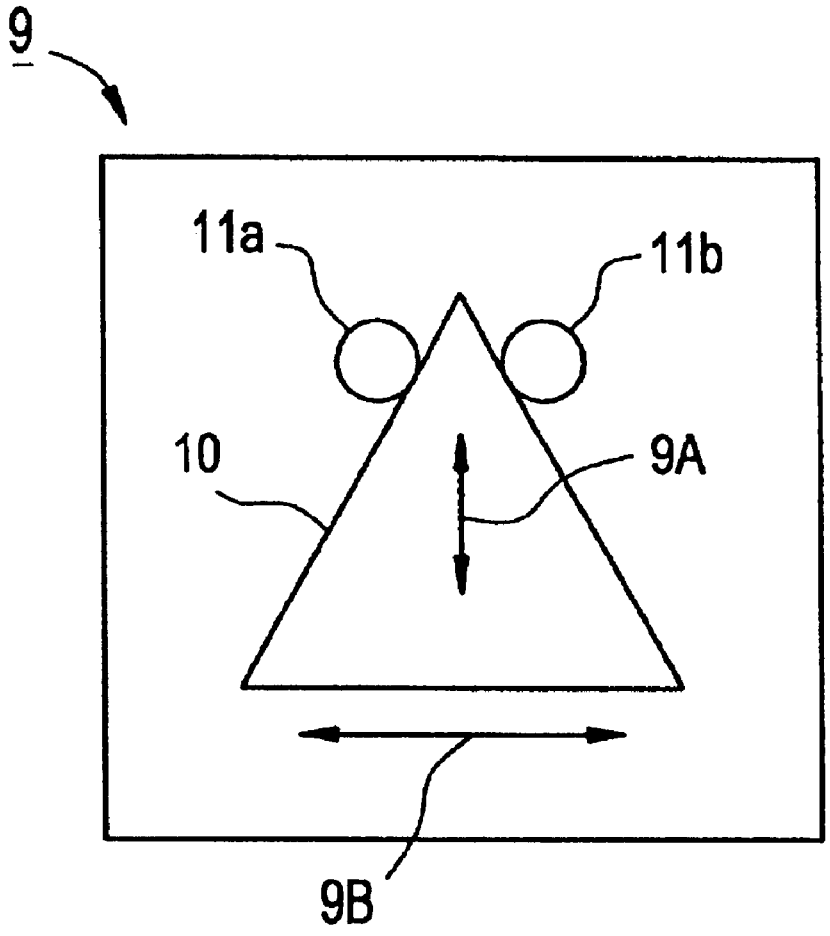
FIG. 16 is a schematic plan view of two resonance modes in the resonator shown in FIG. 3.

Referring to the resonators 1, 6, and 9, the resonance modes in FIGS. 7 to 12 are schematically shown, as indicated by arrows 1A, 1B, 6A, 6B, 9A, and 9B in FIGS. 14 to 16, respectively.

That is, as seen in FIG. 14, in the resonator 1 containing the substantially rectangular metallic film 3, two types of $\lambda/2$ resonance are generated at the resonator lengths which are the intervals between two pairs of the opposed sides, respectively. Furthermore, as seen in FIG. 15, in the resonator 6, two types of $\lambda/2$ resonance are produced at the resonator lengths which are the lengths of the longer and shorter diagonal lines of the substantially rhomboid metallic film 7, respectively. Moreover, as shown in FIG. 16, in the resonator 9 containing the substantially triangular metallic film 10, $\lambda/2$ resonance mode is generated at the resonance length which is the distance between the corner of the substantially triangular metallic film 10 to which the input-output connection points 11*a* and 11*b* are connected and the side of the substantially triangular metallic film 10 to which the input-output connection points 11*a* and 11*b* are not connected, and moreover, $\lambda/2$ resonance mode is caused at the resonance length which is the length of the side to which the input-output connection points are not connected.

As described above, in the resonators 1, 6, and 9 having a microstrip structure, the excited resonance modes are different depending on the shapes of the metallic films and the input-output positions of power with respect to the metallic films. In the above-described results, the resonance forms, the shapes of the metallic films, and the input-output positions have the following relations.

In particular, the resonance modes having different resonance frequencies are produced substantially in parallel to the imaginary straight line passing through the first and second connection points through which power is supplied to the metallic film and, also, substantially in the perpendicular direction to the imaginary straight line. These $\lambda/2$ resonance modes are generated at the resonator lengths which are the lengths in the above-mentioned directions of the metallic films, respectively.

The above-described resonance modes are excited between a pair of sides, a pair of angles, and between a side and an angle, depending on the shapes of the metallic films.

Considering the above-described results, the inventors of the present invention measured changes in resonance frequency (that is, changes of the resonance points 1A and 1B) of the resonance modes 1A and 1B, obtained when the length L in the shorter side direction of the metallic film 3 in the resonator 1 of FIG. 1 is varied. The results are shown in FIG. 17.

Figure 17:
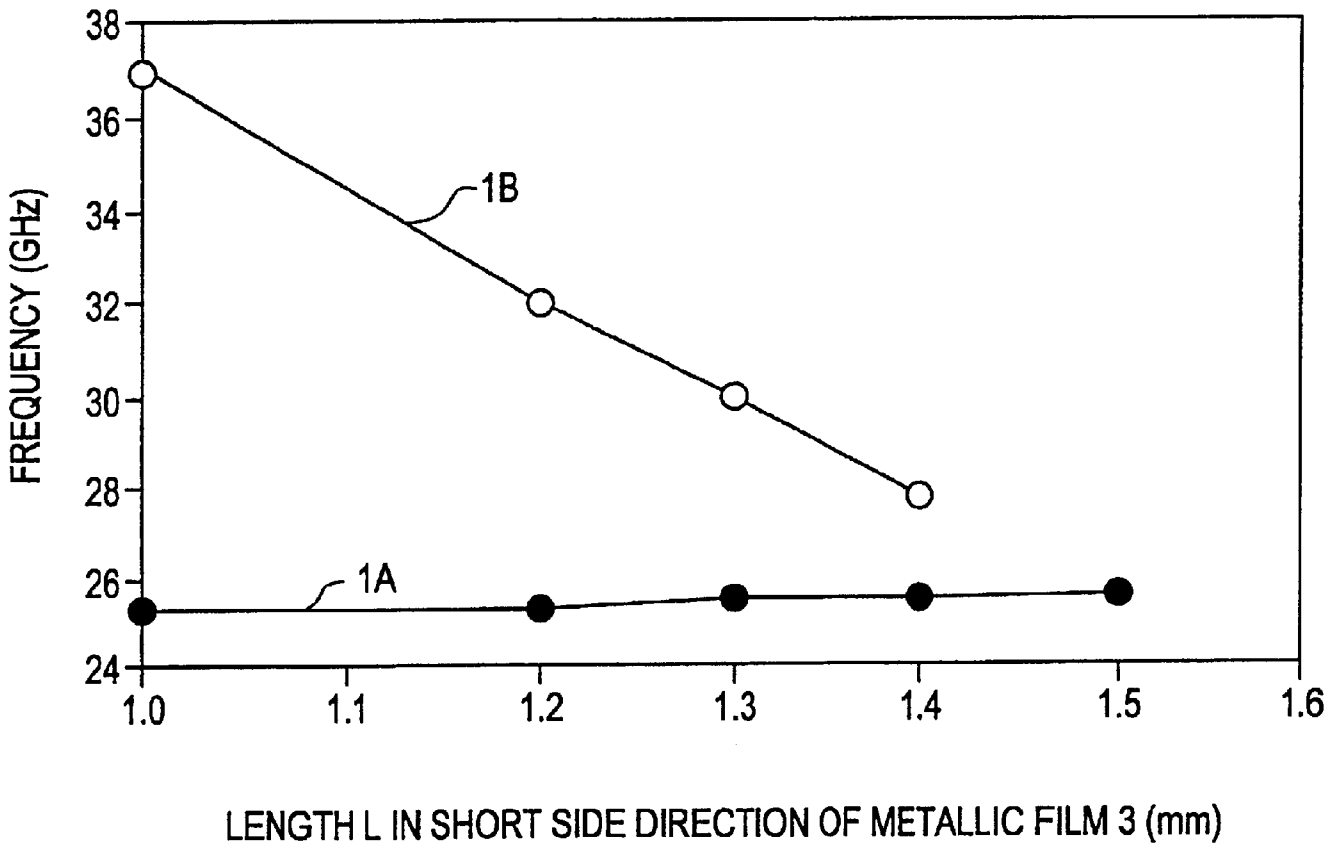
FIG. 17 is a graph showing change of the length L in the short side direction of the metallic film in the resonator shown in FIGS. 1A and 1B, with the resonance frequencies of the resonance 1A at the lowest frequency and the resonance 1B at the next lowest frequency.

In FIG. 17, a solid circle mark represents a resonance point in the resonance mode 1A, while a blank circle mark represents a resonance point 1B in the resonance mode 1B. Regarding the size of the metallic film, the length of the longer side is about 1.6 mm. As seen in FIG. 17, when the length L in the shorter side direction of the metallic film 3 is varied from about 1.0 mm to about 1.5 mm, the resonance frequency in the resonance mode 1A is substantially unchanged, while the resonance frequency in the resonance mode 1B is gradually decreased. This supports that the resonance mode 1B is $\lambda/2$ resonance generated in the shorter side direction of the substantially rectangular metallic film 3 at the resonance length L which is the length L of the short side of the metallic film 3. That is, when the resonance length in the shorter side direction of the metallic film 3 is varied, the resonator length in the shorter side direction is changed, and thereby, the resonance frequency in the resonance mode 1B is changed.

Accordingly, the resonance form to be excited in the metallic film is determined by selection of the shape of the metallic film and the input-output connection points, based on the above-described results. Regarding the resonance form to be produced, it is seen that two desired resonance modes are attained by selecting the shape of the film-pattern, and the input-output positions of power on the film-pattern, that is, the connection points of the input-output coupling circuits, based on the above-described results. In addition, a desired resonance frequency is excited by controlling the size of the metallic film, for example, in the case of the substantially rectangular metallic film of FIG. 17, the length in the shorter side direction thereof, in consideration of the resonance form.

In FIG. 17, the resonator 1 having the substantially rectangular metallic film 3 is described. The resonator 6 having the substantially rhomboid metallic film 7, and the resonator 9 having the substantially triangular metallic film 10 are similar to the resonator 1. The metallic film is not limited to the above-described shapes. That is, the resonance mode to be produced in the metallic film can be controlled by selecting the shape of the metallic film and the connection points of the input-output coupling circuits on the metallic film, as described above.

The inventors of the present invention have discovered that by controlling the shape of the metallic film and the connection points of the input-output coupling circuits as described above, the resonance frequency in at least one of the two resonance modes is controlled. By coupling the two resonance frequencies to each other, a band-pass filter is obtained.

A band-pass filter according to another preferred embodiment of the present invention will be described with reference to FIGS. 18 to 26.

Figure 18:
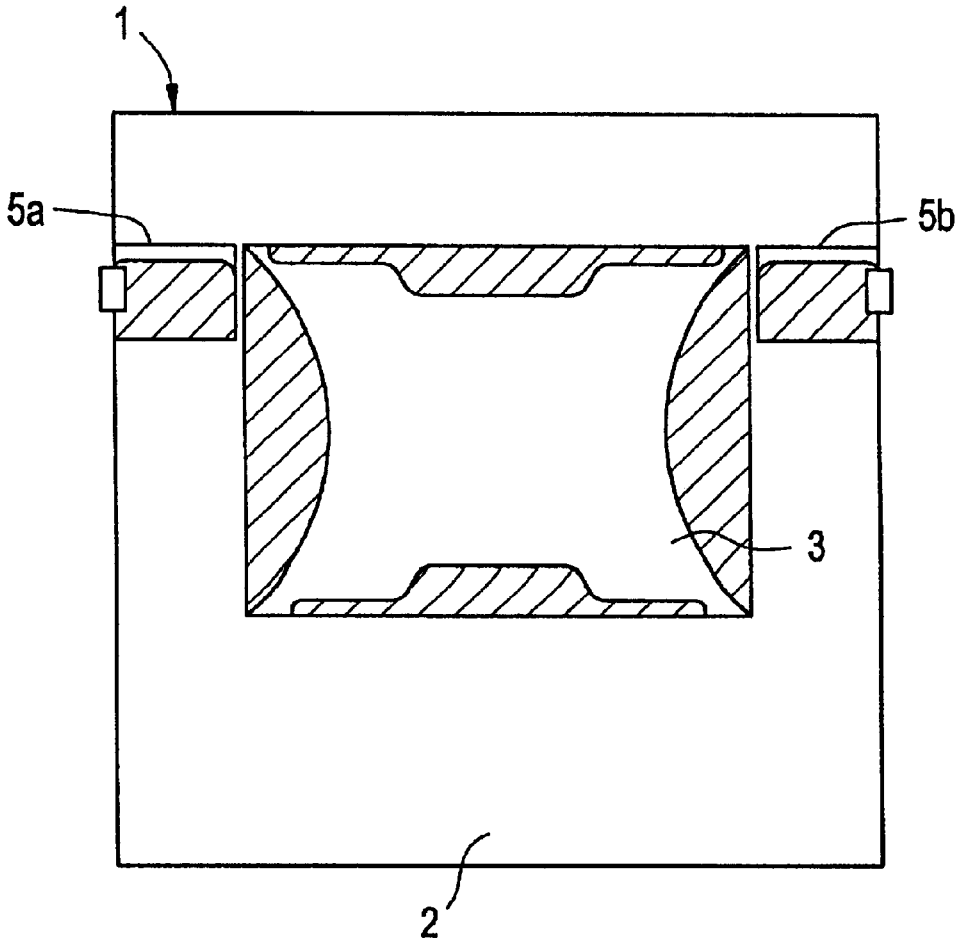
FIG. 18 is a schematic plan view of the resonance current distribution of the resonance 1A at the lowest frequency in the resonator shown in FIGS. 1A and 1B.
Figure 19:
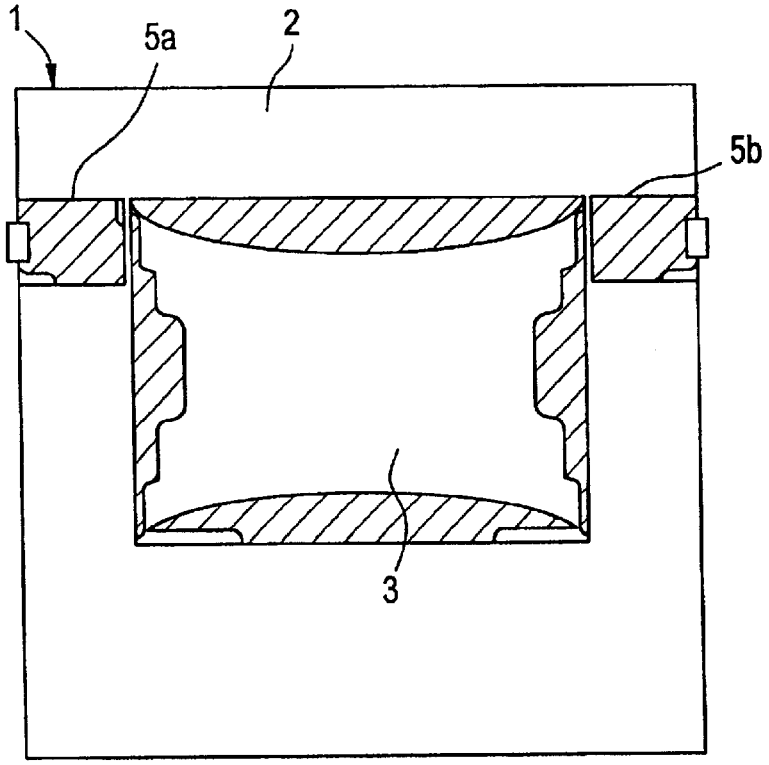
FIG. 19 is a schematic plan view of the resonance 1B at the next lowest frequency in the resonator shown in FIGS. 1A and 1B.

FIGS. 18 and 19 are plan views schematically showing the resonance currents in the resonance modes 1A and 1B in the metallic film of the resonator 1, respectively. In the hatched areas in FIGS. 18 and 19, high resonance currents flow. FIGS. 18 and 19 schematically show the results obtained by an electromagnetic field simulator SONNET manufactured by SONNET SOFTWARE Co.

The electric field and the current have a phase difference of about 90°, and the current flowing in the metallic film is influenced by the edge-concentration effect. From these facts, it can be seen that the current distributions in the resonance modes having the electric field distributions shown in FIGS. 7 and 8 are the same as illustrated in FIGS. 18 and 19.

In the results shown in FIGS. 18 and 19, it can be seen that the areas in which the resonance currents are high in the resonance modes 1A and 1B are different from each other. The above-described results are obtained with respect to the resonator 1. As described above, the areas where the high resonance currents flow become inevitably different from each other, since the resonance mode having the lowest frequency to be excited in the metallic film and the resonance mode having the next lowest frequency are generated substantially in parallel to the imaginary straight line passing through the input-output connection points and substantially in the perpendicular direction to the imaginary straight line, respectively. Accordingly, FIGS. 18 and 19 show the results with respect to the resonator 1. However, in the case of the metallic films having the other shapes and the connection points arranged in the other positions, the areas where high resonance currents flow in the resonance modes having the lowest resonance frequency and the next lowest resonance frequency are inevitably different from each other.

In view of the fact that the areas where high resonance currents flow in the resonance modes 1A and 1B are different from each other, the inventors of the present invention have found that by providing a discontinuous portion to control the flow of the resonance current in one of the resonance modes, the frequency in the area provided with the discontinuous portion is efficiently controlled, and moreover, the two resonance modes are coupled to produce a band-pass filter.

Figure 20:
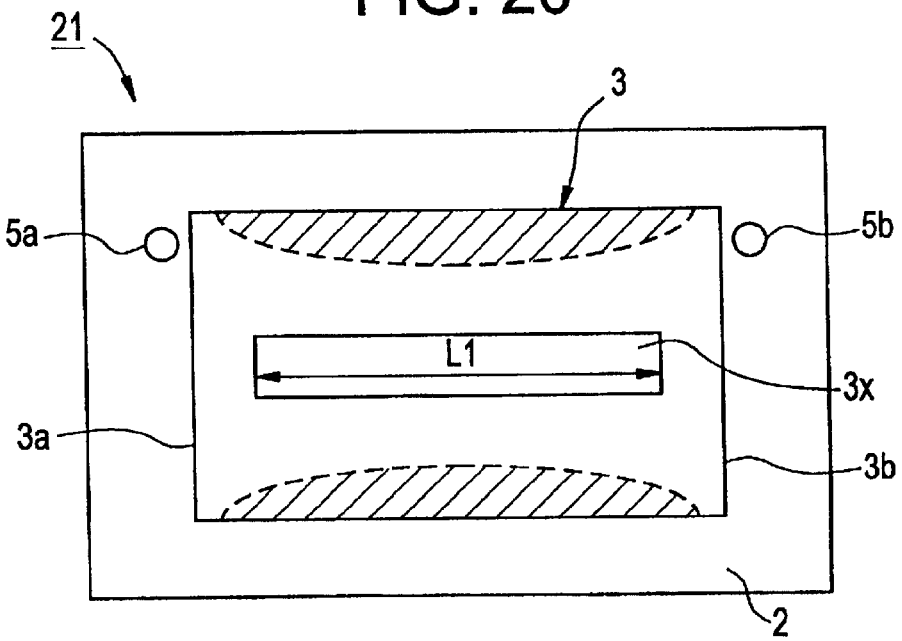
FIG. 20 is a plan view of a band-pass filter according to a preferred embodiment of the present invention in which a relationship between an opening and the areas where high resonance currents in the resonance mode 1A at the lowest frequency flow.

FIG. 20 is a plan view of a band-pass filter according to a preferred embodiment of the present invention. In the band-pass filter 21, an opening 3*x* is formed in the metallic film 3 of a resonator 1. The opening 3*x* is arranged to extend substantially parallel to the longitudinal direction of the metallic film 3 (that is, substantially parallel to the imaginary line passing through the connection points 5*a* and 5*b*). In FIG. 20, the area in which high resonance currents in the resonance mode 1A flow are hatched. That is, it can be seen that the opening 3*x* hardly affects the areas in which the high resonance currents in the resonance mode 1A flow.

Figure 21:
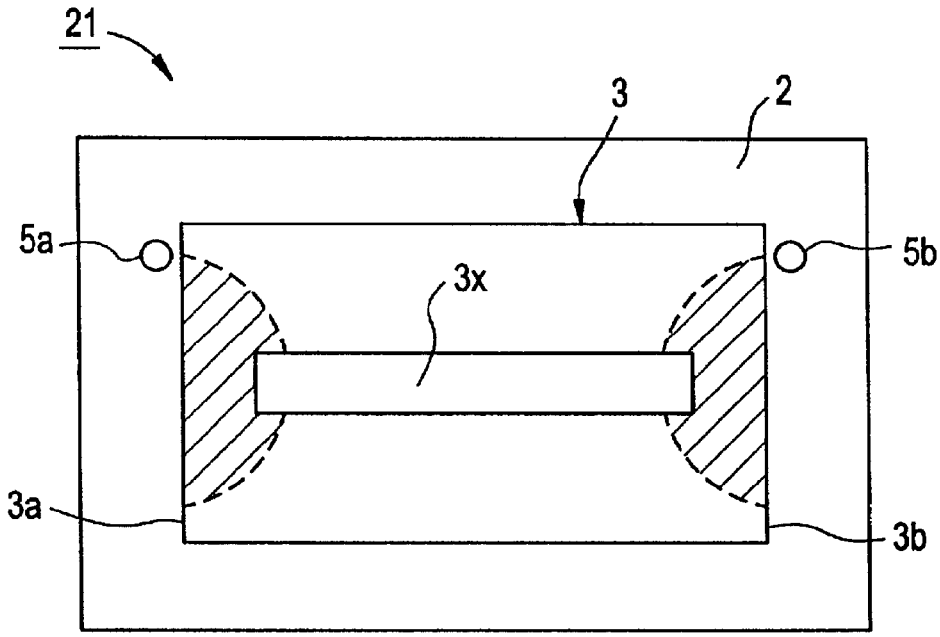
FIG. 21 is a plan view of a band-pass filter according to a preferred embodiment of the present invention which illustrates a relationship between an opening and the areas where high resonance currents in the resonance mode 1A at the next lowest frequency flow.

On the other hand, FIG. 21 is a schematic plan view showing the hatched areas in which high resonance currents flow in the resonance mode 1B. As seen in FIG. 21, an opening 3*x* produces discontinuous areas in which high resonance current in the resonance mode 1B is produced. Thus, the resonance current in the resonance mode 1B is greatly influenced by the opening 3*x*. In the resonance mode 1A, the discontinuous portion is provided in the area in which substantially no resonance current flows, and therefore, the opening 3*x* produces substantially no changes.

Accordingly, by providing the opening 3*x* in the metallic film 3, only the resonance frequency in the resonance mode 1B is reduced, due to the discontinuity of the resonance current.

Moreover, by changing the shape of the opening 3*x*, the effect of the discontinuous portion is efficiently controlled, and accordingly, the resonance frequency in the resonance mode 1B is efficiently controlled.

Figure 22:
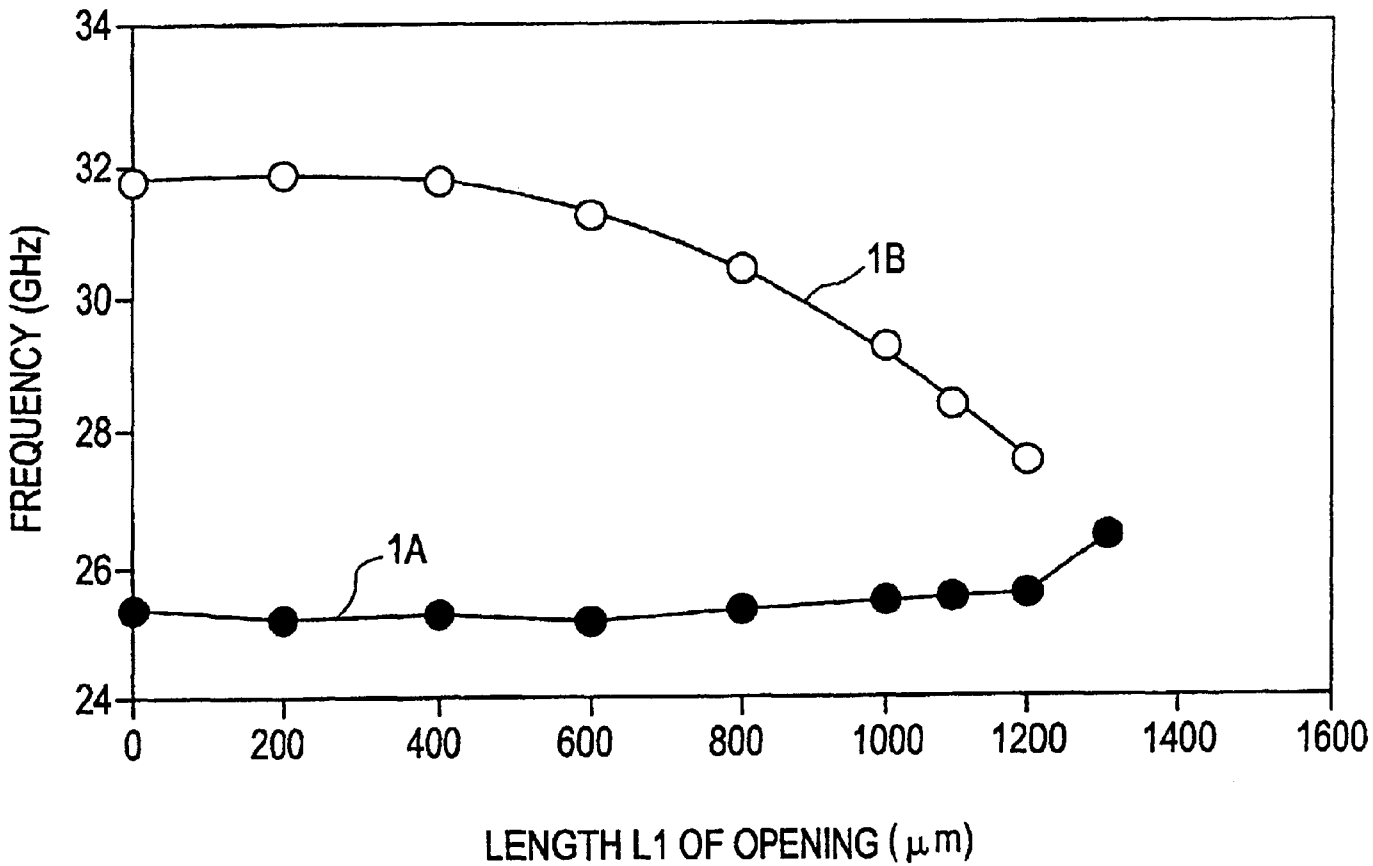
FIG. 22 is a graph showing change of the resonance 1A at the lowest frequency and the resonance 1B at the next lowest frequency, obtained when an opening is formed in the resonator shown in FIGS. 1A and 1B.

FIG. 22 shows changes in frequency in the resonance modes 1A and 1B obtained when the length L1 of the opening 3X is varied. The size of the metallic film 3 is the same as that in FIG. 17 which shows the characteristics.

As seen in FIG. 22, when the length L1 of the opening is varied, the resonance frequency in the resonance mode 1A is not substantially changed, and the resonance frequency in the resonance mode 1B is gradually reduced and reaches the resonance frequency in the resonance mode 1A.

A method of controlling the resonance frequency in the resonance mode 1B in the band-pass filter 21 using the resonator 1 is described above. The principle is generally applied. In the case of the resonators 6 and 9, other similar resonators including metallic films with shapes different from those of the resonator 6 and 9 may be used. The resonance frequency in one of the resonance modes is controlled by providing a resonance current controlling mechanism, for example, an opening as described above which makes discontinuous at least a portion of resonance currents in one of the resonance modes as described above.

An example in which the resonance frequency in the resonance mode 1B of the substantially rectangular metallic film 3 is controlled is described above. The resonance frequency in the resonance mode 1A is efficiently controlled. That is, the resonance frequency in the resonance mode 1A is controlled by providing, instead of the opening 3X, an opening extended to the areas in which high resonance currents in the resonance mode 1A flow.

That is, according to various preferred embodiments of the present invention, in the resonator having the input-output coupling circuits connected to first and second portions of the periphery of the metallic film, at least a portion of the resonance current or resonance electric field is discontinuous, whereby the discontinuous resonance frequency in the resonance mode is controlled. In other words, regarding the resonance modes having the lowest frequency, excited in the metallic film, and the resonance mode having the next lowest frequency, the areas where high resonance currents flow are different from each other as described above. Therefore, the resonance modes are individually controlled.

Both of the resonance frequencies are controlled, by controlling the resonance currents in the first and second resonance modes 1A and 1B.

Furthermore, the discontinuous portion for producing discontinuous resonance currents is not limited to the opening 3*x*.

Figure 23A:
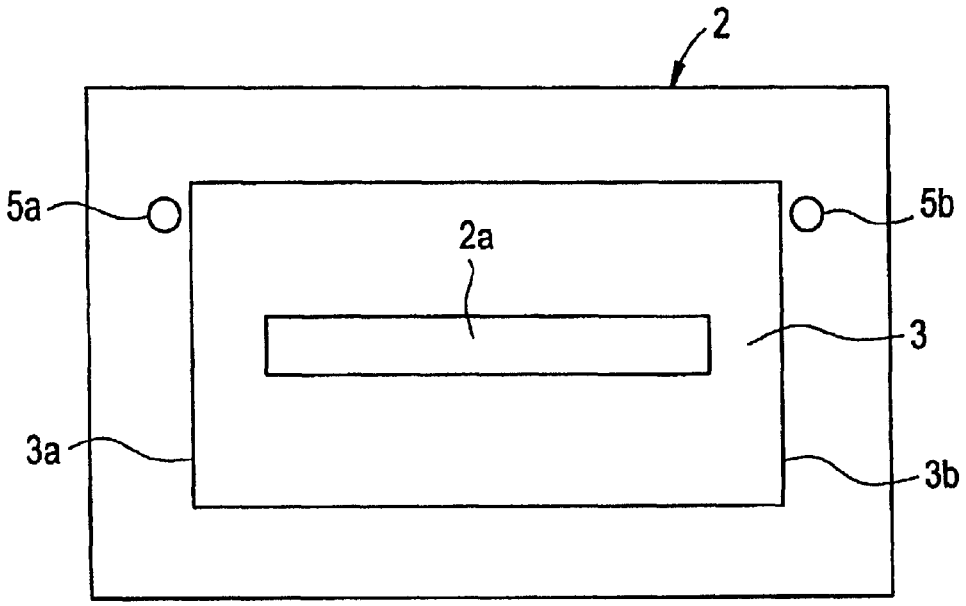
FIG. 23A is a plan view of a modification example of the band-pass filter according to the preferred embodiment of the present invention.
Figure 23B:
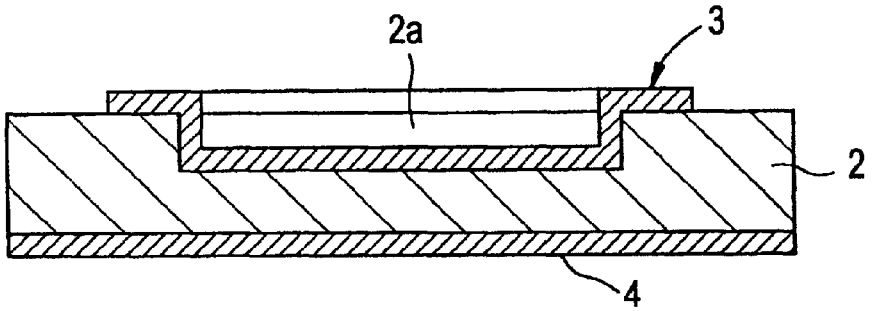
FIG. 23B is a cross sectional view thereof.

For example, as shown in FIGS. 23A and 23B, a concavity 2*a* may be provided in a portion of the dielectric substrate 2, and the metallic film 3 is configured to extend onto the concavity 2*a*. In this case, the distance between the ground electrode 4 and the metallic film 3 is relatively short in the portion of the substrate 2 where the concavity 2*a* is provided. Accordingly, the distance between the ground electrode 4 and the metallic film 3 is discontinuous, whereby the area in which the high strength resonance electric field in the resonance mode 1B is generated is discontinuous.

Figure 24A:
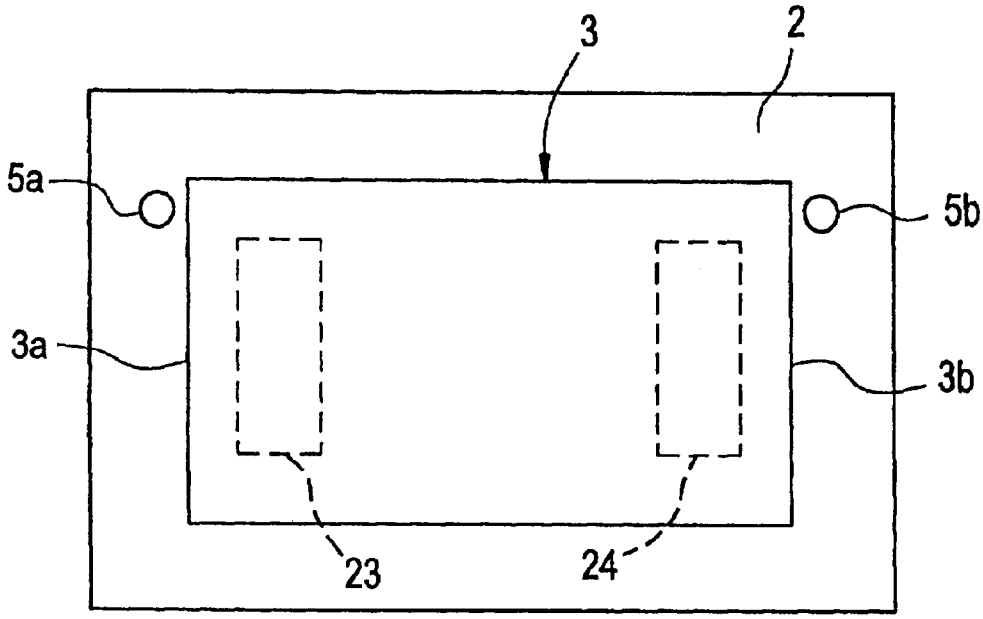
FIG. 24A is a plan view of another modification example of the band-pass filter according to the preferred embodiment of the present invention.
Figure 24B:
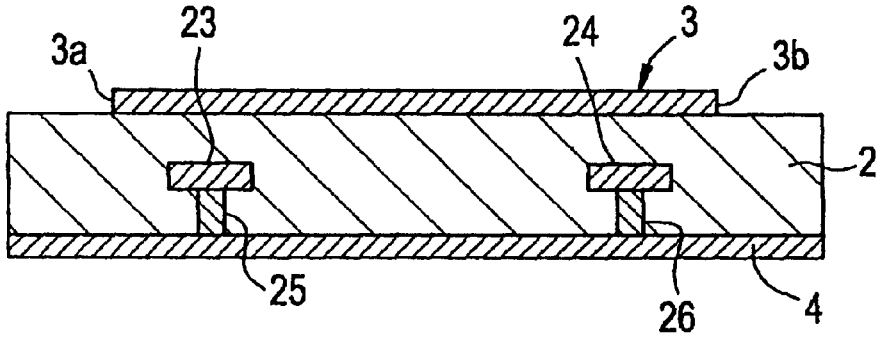
FIG. 24B is a cross sectional view thereof.

In addition, internal electrodes 23 and 24 as electrodes for controlling a resonance electric field are provided inside of a dielectric substrate and positioned in the portion of the substrate where the resonance electric field in the resonance mode 1B is high, as shown in FIGS. 24A and 24B. The internal electrodes 23 and 24 are electrically connected to the ground electrode via via-hole electrodes 25 and 26. In this case, the resonance electric field is discontinuous in the portion of the substrate where the internal electrodes 23 and 14 are provided. Thus, the resonance electric field is controlled.

In preferred embodiments of the present invention, the discontinuous portion is preferably located in the portion which produces discontinuous areas in which resonance current or resonance electric field strength is high whereby the resonator length $\lambda/2$ is adjusted. The structure of the discontinuous portion is not particularly limited.

Figure 25:
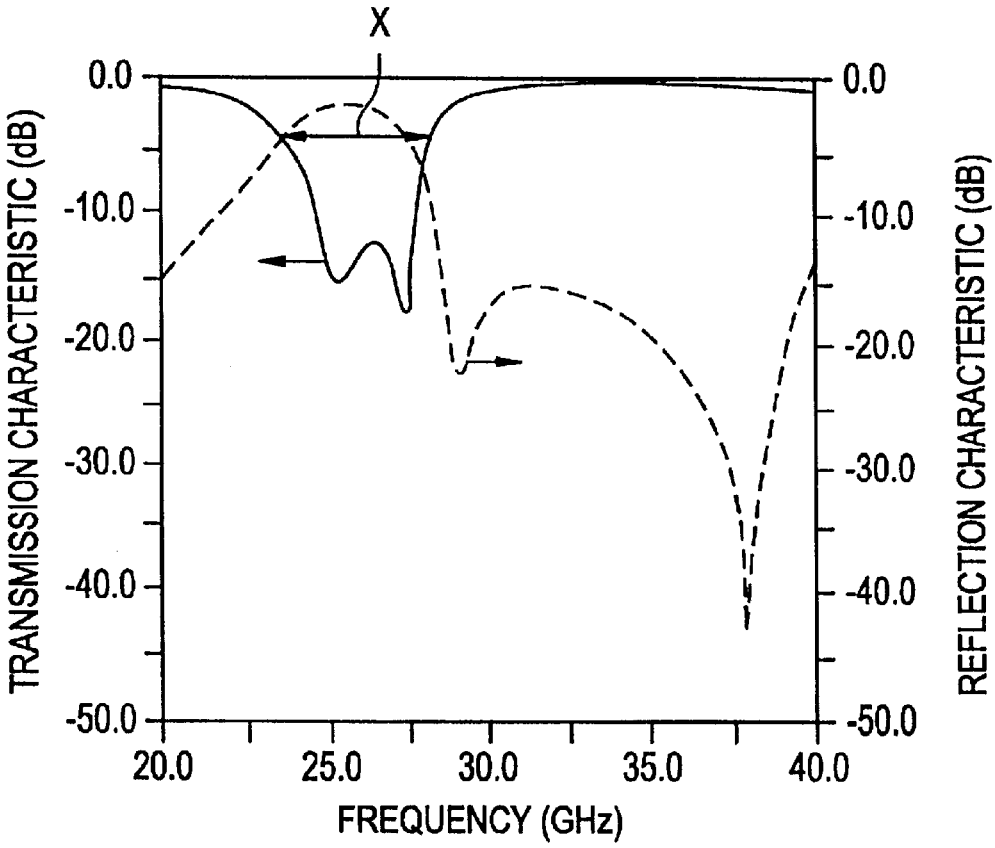
FIG. 25 is a graph showing the frequency characteristics of the band-pass filter according to the preferred embodiment of the present invention.
Figure 26:
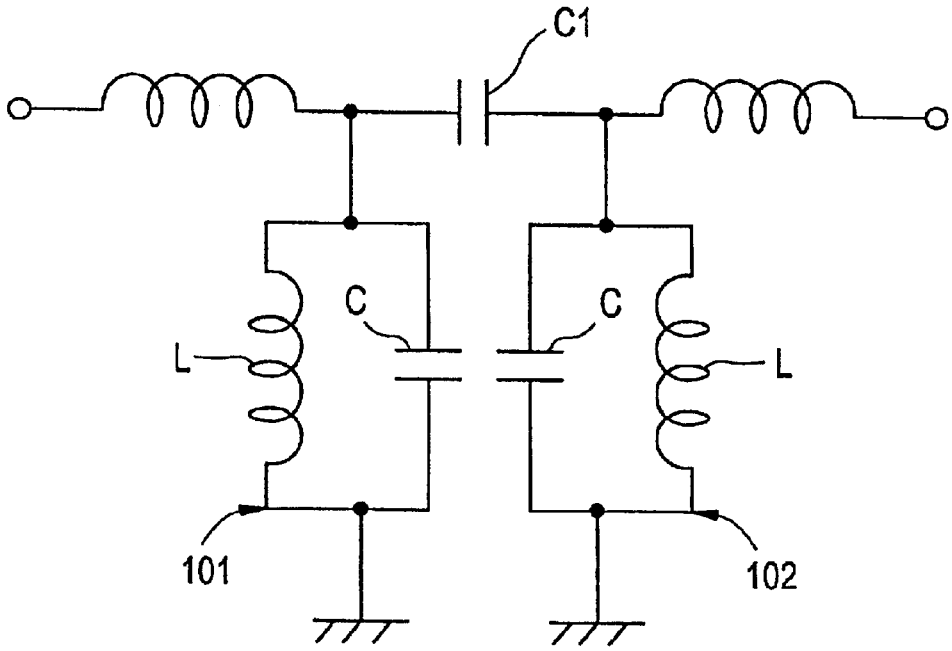
FIG. 26 PRIOR ART
FIG. 26 shows a circuit arrangement of an LC filter as a conventional band-pass filter.

As seen in the above-description, in the microstrip type resonator having one metallic film provided on the dielectric substrate, and the input-output coupling circuits connected to the first and second portions of the periphery of the metallic film, the first resonance mode propagated substantially parallel to the imaginary line passing through the connection points of the input-output coupling circuits and the second resonance mode propagated substantially perpendicular to the imaginary line are generated, and by making discontinuous at least a portion of the resonance current or resonance electric field in at least one of the first, second resonance modes, the resonance frequency in at least one of the first and second resonance modes are controlled. Accordingly, by controlling the degree of the discontinuity provided as described above, the first and second resonance modes are coupled, and therefore, a band-pass filter is produced. FIG. 25 is a graph showing the frequency characteristics of the band-pass filter as an example of preferred embodiments of the present invention, based on the above-described discoveries. The solid line represents the transmission characteristic, and the broken line represents the reflection characteristic.

The specific example of the configuration of the band-pass filter is as follows:

- dielectric substrate: a substantially rectangular sheet-shaped substrate including a dielectric substrate with approximate dimensions of 2.4×2.4 mm, made of a material having $\epsilon r$=9.8 (alumina)
- metallic film: a metallic film with approximate dimensions of 1.6×1.2 mm×4 $\mu$m in thickness, made of Cu.
- ground electrode: a Cu film having a thickness of about 4 $\mu$m, provided on the entire bottom surface of the dielectric substrate.
- opening 3*x*: with approximate dimensions of 200 $\mu$m×1000 $\mu$m, passing the center of the metallic film, and extending substantially parallel to the longer sides of the metallic film.
- the positions of the input-output connection points: in the opposed shorter sides of the metallic film and 0 mm distance from the corners defined by the shorter sides and one of the longer sides.

As seen in FIG. 25, in the band-pass filter of this preferred embodiment, the resonance modes 1A and 1B are coupled, whereby a wide pass-band width in a microwave band to milli-wave band, shown by arrow X can be obtained.

Heretofore, the band-pass filter is described which uses the microstrip type resonator in which one metallic film is provided on the dielectric substrate, and the ground electrode is provided on the bottom surface of the dielectric substrate. However, the band-pass filter is not limited to the use of the microstrip type resonator, provided that the first and second resonance modes are generated, based on the relationship between the shape of the above-described metallic film and the connection points of the input-output coupling circuits, and are coupled by making discontinuous at least a portion of the resonance currents or resonance electric fields in the first and second resonance modes. The band-pass filter of preferred embodiments of the present invention may have a triplate structure. Accordingly, the above metallic film may be provided inside of the dielectric substrate, in addition to the surface of the dielectric substrate.

According to the method of producing a band-pass filter of a preferred embodiment of the present invention, the shape of the metallic film and the connection points of the input-output coupling circuits with respect to the metallic film are selected so that the first and second resonance modes are generated in the metallic film. That is, the resonance forms of the first and second resonance modes are determined by selection of the shape of the metallic film and the connection point-positions. The first and second resonance modes of which the resonance forms are determined as described above are coupled to each other by controlling the resonance current or resonance electric field in at least one of the first and second resonance modes.

According to the method of producing a band-pass filter of a preferred embodiment of the present invention, a band-pass filter which operates in a high frequency band is easily provided only by controlling the shape of the metallic film, the connection point-positions of the input-output coupling circuits, and the resonance current or the resonance electric field in at least one of the resonance modes so that one of the resonance modes is coupled to the other resonance mode.

Furthermore, the shape of the metallic film and the connection points of the input-output coupling circuits are simply selected so that the first resonance mode propagated substantially parallel to the imaginary straight line passing through the connection points of the input-output coupling circuits, and the second resonance mode propagated substantially perpendicular to the imaginary straight line are generated. Accordingly, the shape of the metallic film has substantially no restrictions. The band-pass filter is provided by use of the metallic film having such a shape that has never been used. As regards the connection points of the input-output coupling circuits, the flexibility of the positions is greatly enhanced. Therefore, the design flexibility of the band-pass filter is greatly improved.

In addition, the first and second resonance modes are coupled by making discontinuous at least a portion of the resonance current and the resonance electric field in at least one of the resonance modes. Thus, band-pass filters having different pass-bands are easily provided.

In the band-pass filter of preferred embodiments of the present invention, the input-output coupling circuits are connected to first and second portions of the periphery of one metallic film provided on the surface of the dielectric substrate or inside thereof, the first resonance mode propagated substantially parallel to the imaginary straight line passing through the connection points of the input-output coupling circuits, and the second resonance mode propagated substantially perpendicular to the imaginary straight line are generated, and a coupling mechanism for making discontinuous at least a portion of the resonance current or resonance electric field is provided so that the first and second resonance modes are coupled to each other. Accordingly, a band-pass filter is provided in which the pass-band achieves a desired frequency band by selection of the shape of the metallic film and the connection-point positions of the input-output coupling circuits, and coupling the first and second resonance modes by the above coupling mechanism.

In the band-pass filter of preferred embodiments of the present invention, different pass-bands are easily produced only by selection of the shape of one metallic film and the connection positions of the input-output coupling circuits as described above. Accordingly, the structure of the band-pass filter which can be operated in a high frequency band is greatly simplified. Furthermore, the size accuracy control carried out during production is easily performed.

A band-pass filter which operates in a high frequency band is simply and inexpensively provided.

The above-described coupling mechanism makes discontinuous at least a portion of the resonance current or resonance electric field in at least one of the resonance modes. Thus, the coupling mechanism may be a resonance current control mechanism for making discontinuous at least a portion of the resonance current, or may be a resonance electric field control mechanism for controlling the resonance electric field.

In the case of the resonance current control mechanism, the opening is simply provided in the metallic film, whereby the resonance current control mechanism is easily provided. In the resonance electric field control mechanism, a resonance electric field control electrode is simply provided to oppose the metallic film through at least a portion of the layers of the dielectric substrate, whereby the resonance electric field control mechanism is easily provided.

While the preferred embodiments have been described, it is to be understood that modifications will be apparent to those skilled in the art without departing from the scope of the invention, which is to be determined solely by the following claims.

What is claimed is:

1. A method of producing a band-pass filter comprising the steps of:

selecting the shape of a metallic film and the connection points of input-output coupling circuits, said metallic film being provided on a surface of a dielectric substrate or inside of the dielectric substrate, wherein the shape of the metallic film and the positions of the connection points of the input-output coupling circuits are selected such that a first resonance mode propagated substantially parallel to an imaginary straight line passing through the connection points of the input-output circuits and a second resonance mode propagated substantially perpendicular to the imaginary straight line are generated, the first and second resonance modes have different resonance frequencies; and making discontinuous at least a portion of the resonance current and the resonance electric field in at least one of the resonance modes so that the resonance frequency of one of the first and second resonance modes reaches the resonance frequency of the other of the first and second resonance modes and so that the first and second resonance modes are coupled.

2. A method of producing a band-pass filter according to claim 1, wherein in the step in which the first and second resonance modes are coupled, at least a portion of the resonance current in at least one of the resonance modes is made discontinuous.

3. A method of producing a band-pass filter according to claim 1, wherein in the step in which the first and second resonance modes are coupled, at least a portion of the resonance electric field in at least one of the resonance modes is made discontinuous.

4. A method of producing a band-pass filter according to claim 1, wherein the shape of the metallic film is selected to be substantially rectangular in the selecting step.

5. A method of producing a bend-pass filter according to claim 1, wherein the shape of the metallic film is selected to be substantially triangular in the selecting step.

6. A method of producing a band-pass filter according to claim 1, wherein the shape of the metallic film is selected to be substantially rhomboid in the selecting step.

7. A method of producing a band-pass filter according to claim 4, wherein said connection points of said input-output coupling circuits are selected to be on one side of an imaginary straight line passing through each center point of opposite ends of said substantially rectangular-shaped metallic film in the selecting step.

8. A method of producing a band-pass filter according to claim 5, wherein said connection points of said input-output coupling circuits are selected to be at adjacent sides of said substantially triangular-shaped metallic film in the selecting step.

9. A method of producing a band-pass filter according to claim 6, wherein said connection points of said input-output coupling circuits are selected to be on adjacent sides of said substantially rhomboid-shaped metallic film in the selecting step.

10. A method of producing a band-pass filter according to claim 7, wherein the connection points of said input-output coupling circuits are arranged around the shorter ends of said substantially rectangular-shaped metallic film.

* * * * *